US006935146B1

(12) United States Patent
Lin

(10) Patent No.: US 6,935,146 B1
(45) Date of Patent: Aug. 30, 2005

(54) CHANGEABLE LOCK ASSEMBLY

(75) Inventor: Vance Lin, Hsinchuang (TW)

(73) Assignee: Vance Lock Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/782,877

(22) Filed: Feb. 23, 2004

(51) Int. Cl.[7] ..... E05B 27/06

(52) U.S. Cl. ..... 70/338; 70/341; 70/343; 70/358; 70/375; 70/383; 70/384; 70/493

(58) Field of Search ..... 70/337–343, 382–385, 70/419, 358, 375, 493–495, DIG. 71, DIG. 75

(56) References Cited

U.S. PATENT DOCUMENTS

| | | | | | |
|---|---|---|---|---|---|
| 856,556 | A * | 6/1907 | Townsend et al. | ..... | 70/339 |
| 1,650,564 | A * | 11/1927 | Wolff | ..... | 70/493 |
| 1,979,938 | A * | 11/1934 | Jacobi | ..... | 70/369 |
| 2,422,600 | A * | 6/1947 | Swanson | ..... | 70/340 |
| 2,427,837 | A * | 9/1947 | Connell | ..... | 70/383 |
| 3,181,320 | A * | 5/1965 | Bauer | ..... | 70/421 |
| 3,599,456 | A * | 8/1971 | Bessim | ..... | 70/493 |
| 4,078,406 | A * | 3/1978 | Genakis | ..... | 70/493 |
| 4,185,480 | A * | 1/1980 | Pechner | ..... | 70/358 |
| 4,741,188 | A * | 5/1988 | Smith | ..... | 70/383 |
| 5,000,019 | A * | 3/1991 | Foster | ..... | 70/338 |
| 5,060,494 | A * | 10/1991 | Moorhouse | ..... | 70/419 |
| 6,748,777 | B1 * | 6/2004 | Livingston | ..... | 70/369 |

* cited by examiner

*Primary Examiner*—Lloyd A. Gall
(74) *Attorney, Agent, or Firm*—Dennison, Schultz, Dougherty & MacDonald

(57) ABSTRACT

A lock assembly has a housing, a cylinder, a main adjusting pin assembly, a sub-adjusting pin assembly and multiple locking pin assemblies. The housing has multiple sets of pin holes, two main adjusting holes and two sub-adjusting holes. The three holes of the sets of pin holes are respectively referred to as a changing position, an open position and a lock position of the lock assembly. The cylinder is rotatably received in housing and has a main adjusting hole, a main adjusting cavity, a sub-adjusting hole, a sub-adjusting cavity and multiple pin holes. The adjusting pin assemblies are mounted respectively in the main adjusting holes and the sub-adjusting holes in the housing and the cylinder to selectively block the rotation interface of the lock assembly. The locking pin assemblies are mounted respectively in the pin holes. Accordingly, the lock assembly is changeable to fit with different keys.

12 Claims, 7 Drawing Sheets

CHANGEABLE LOCK ASSEMBLY

BACKGROUND OF THE INVENTION

1. Field of the Invention

The present invention relates to a lock assembly, and more particularly to a changeable lock assembly that can is changeable for fitting with different keys.

2. Description of Related Art

In a public area, such as a library, a station, a gym or a pool, there are cabinets for temporarily storing objects. In such a cabinet, a lock is mounted to keep the cabinet from being unauthorizedly opened.

However, because a conventional lock is unchangeable and is for use with a single key, the safety of using the cabinet will be lost when the key has been illegally copied. Therefore, the locks on the cabinets will be exchanged after a period of use to keep the abovementioned situation from occurring, but this is troublesome to a janitor or other responsible person.

In addition, when the key is lost, the way of taking the objects out of a locked cabinet is to detach or destroy the lock. To reassemble the lock or to replace with a new lock is extremely troublesome, time-consuming and costly.

To overcome the shortcomings, the present invention tends to provide a lock assembly to mitigate or obviate the aforementioned problems.

SUMMARY OF THE INVENTION

The main objective of the invention is to provide a lock assembly that is changeable to fit with different keys.

The lock assembly has a housing, a cylinder, a main adjusting pin assembly, a sub-adjusting pin assembly and multiple locking pin assemblies. The housing has a central hole, multiple sets of pin holes, two main adjusting holes and two sub-adjusting holes. The sets of pin holes are defined in the housing and communicate with the central hole. Each set of pin holes has three pin holes arranged in a curve along the outer surface of the housing. The three holes of the sets of pin holes in the housing are respectively referred to as a changing position, an open position and a lock position of the lock assembly. The main adjusting holes are radially defined in the housing, communicate with the central hole and are respectively referred to as the changing position and the open position. The sub-adjusting holes are radially defined in the housing, communicate with the central hole and are respectively referred to as the changing position and the open position. The cylinder is rotatably received in the central hole of the housing along a first rotating direction and a second rotating direction. The cylinder has a key hole, a main adjusting hole, a main adjusting cavity, a sub-adjusting hole, a sub-adjusting cavity and multiple pin holes. The outer surface of the cylinder abuts the inner surface of the central hole in the housing to define a rotation interface between the housing and the cylinder. The main adjusting hole is defined in the outer surface of the cylinder, communicates with the key hole and selectively aligns with one of the main adjusting holes in the housing when the cylinder is rotated relative to the housing. The main adjusting cavity is defined in the outer surface of the cylinder, communicates with the main adjusting hole in the cylinder and extends along the first rotating direction. The sub-adjusting hole is defined in the outer surface of the cylinder, communicates with the key hole and selectively aligns with one of the sub-adjusting holes in the housing when the cylinder is rotated relative to the housing. The sub-adjusting cavity is defined in the outer surface of the cylinder, communicates with the main adjusting hole in the cylinder and extends along the second rotating direction. The pin holes are defined in the outer surface of the cylinder, communicate with the key hole, are arranged in a row and are selectively aligned with one row of the pin holes in the housing when the cylinder is rotated relative to the housing. The main adjusting pin assembly is mounted in the main adjusting holes in the housing and the cylinder to block the rotation interface at the main adjusting holes in the housing and the cylinder when a main key is inserted into the key hole in the cylinder at the open position of the lock assembly. The sub-adjusting pin assembly is mounted in the sub-adjusting holes in the housing and the cylinder to block the rotation interface at the sub-adjusting holes in the housing and the cylinder when a sub key is inserted into the key hole in the cylinder at the changing position of the lock assembly. The locking pin assemblies are mounted respectively in the set of pin holes in the housing and a corresponding pin hole in the cylinder.

Other objects, advantages and novel features of the invention will become more apparent from the following detailed description when taken in conjunction with the accompanying drawings.

DETAILED DESCRIPTION OF PREFERRED EMBODIMENT

Figure 1:
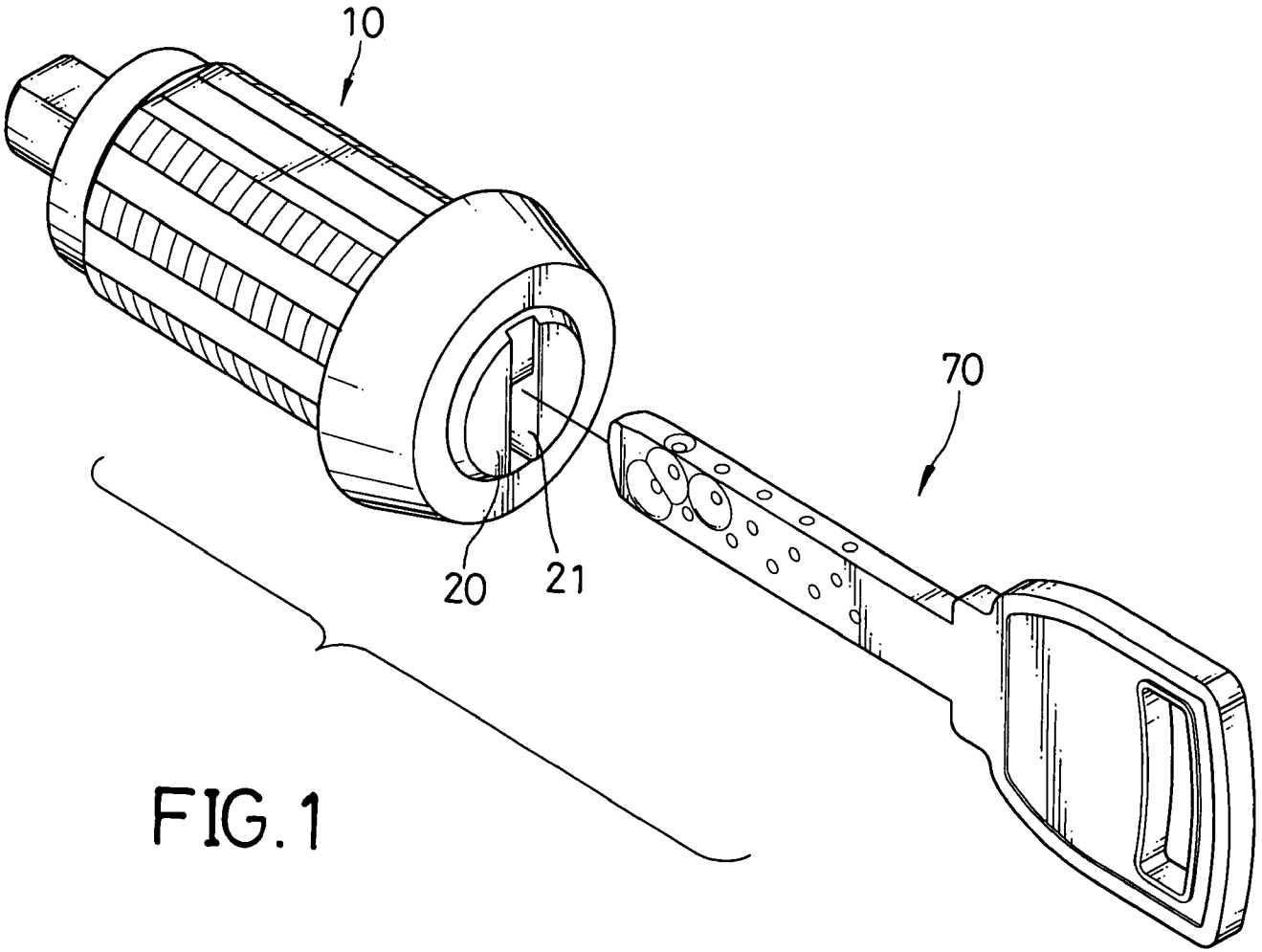
FIG. 1 is an exploded perspective view of a main key and a lock assembly in accordance with the present invention.
Figure 2:
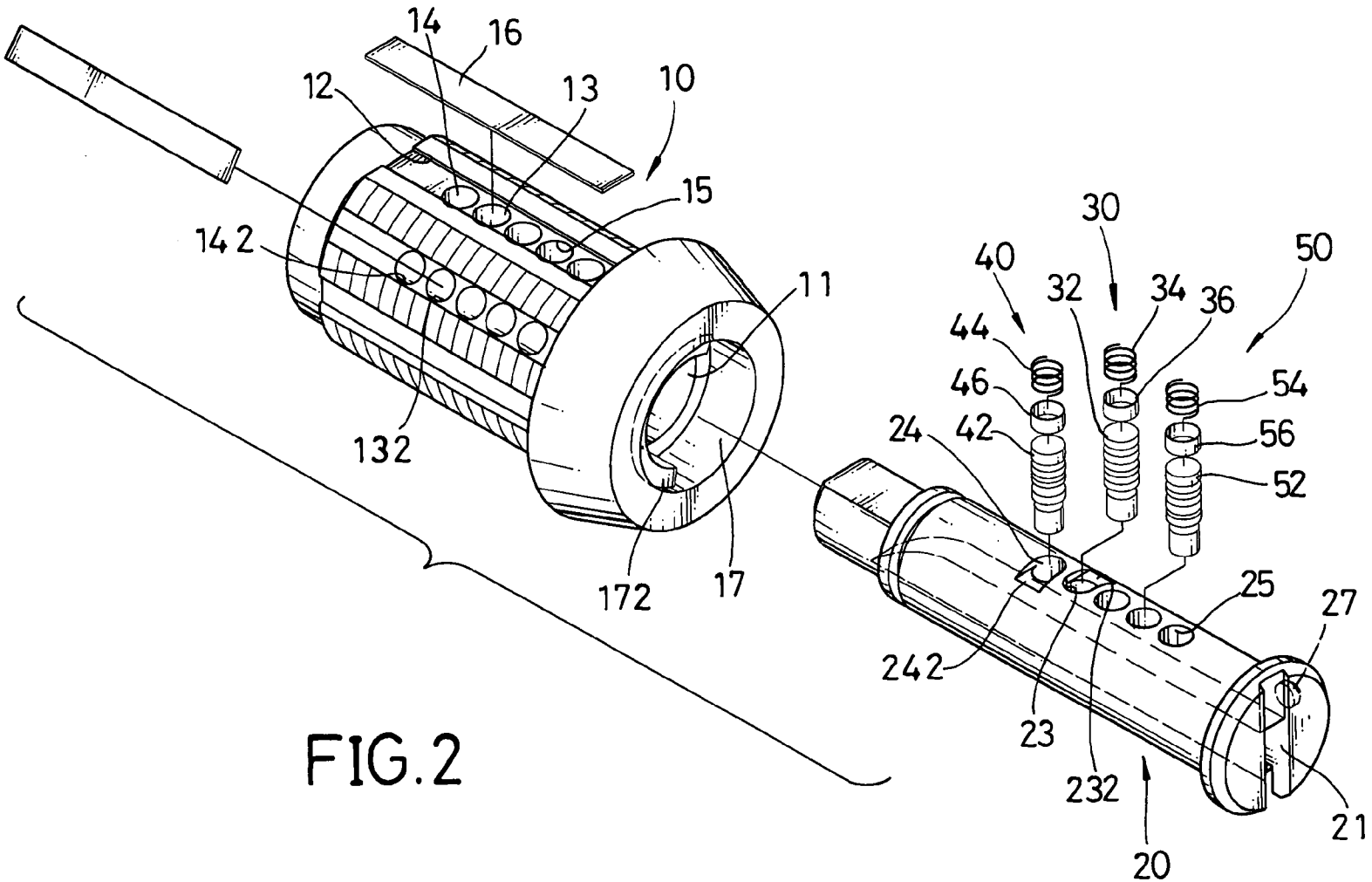
FIG. 2 is an exploded perspective view of the lock assembly in FIG. 1.

With reference to FIGS. 1 and 2, a lock assembly in accordance with the present invention comprises a housing (10), a cylinder (20), a main adjusting pin assembly (30), a sub-adjusting pin assembly (40) and multiple locking pin assemblies (50).

The housing (10) has an outer surface, a proximal end, a central hole (11), multiple longitudinal recesses (12), two main adjusting holes (13,132), two sub-adjusting holes (14,142) and multiple sets of pin holes (15). The central hole (11) is defined through the housing (10) and has an inner surface. The longitudinal recesses (12) are longitudinally defined in the outer surface of the housing (10) and each has a bottom.

The main adjusting holes (13, 132) are radially defined in the housing (10) and communicate with the central hole (11). The sub-adjusting holes (14, 142) are radially defined in the housing (10) and communicate with the central hole (11). The sets of pin holes (15) are defined in the housing (10) and communicate with the central hole (11). Each set of pin holes (15) has three pin holes (15) arrange in a curve along the outer surface of the housing (10) to make three rows of pin holes (15) in the housing (10). In a preferred embodiment, the adjusting holes (13, 132, 14, 142) and the pin holes (15) are defined in the bottoms of the longitudinal recesses (12).

The three pin holes (15) of each set in the housing (10) are respectively referred to as a changing position, an open position and a lock position of the lock assembly. The two main adjusting holes (13,132) in the housing (10) are respectively referred to as the changing position and the open position, and the sub-adjusting holes (14,142) in the housing (10) are also referred respectively to as the changing position and the open position.

Multiple lids (16) are mounted respectively in the longitudinal recesses (12) to close the holes (13,132,14,142,15) in the bottoms of the recesses (12). An opening (17) with an inner surface is defined in the proximal end, and a curved stop (172) is formed on the inner surface of the opening (17).

The cylinder (20) is rotatably received in the central hole (11) of the housing (10) along a first rotating direction and a second rotating direction opposite to the first rotating direction. The cylinder (20) has an outer surface, a proximal end, a key hole (21), a main adjusting hole (23), a main adjusting cavity (232), a sub-adjusting hole (24), a sub-adjusting cavity (242) and multiple pin holes (25). The outer surface of the cylinder (20) abuts with the inner surface of the central hole (11) in the housing (10) to define a rotation interface between the housing (10) and the cylinder (20).

The key hole (21) is defined in the proximal end of the cylinder (20). The main adjusting hole (23) is defined in the outer surface of the cylinder (20) and communicates with the key hole (21). The main adjusting hole (23) is selectively aligned with one of the main adjusting holes (13,132) in the housing (10) when the cylinder (20) is rotated relative to the housing (10). The main adjusting cavity (232) is defined in the outer surface of the cylinder (20), communicates with the main adjusting hole (23) in the cylinder (20) and extends along the first rotating direction.

The sub-adjusting hole (24) is defined in the outer surface of the cylinder (20) and communicates with the key hole (21). The sub-adjusting hole (24) is selectively aligned with one of the sub-adjusting holes (14,142) in the housing (10) when the cylinder (20) is rotated relative to the housing (10). The sub-adjusting cavity (242) is defined in the outer surface of the cylinder (20), communicates with the sub-adjusting hole (24) in the cylinder (20) and extends along the second rotating direction.

The pin holes (25) are defined in the outer surface of the cylinder (20) and communicates with the key hole (21). The pin holes (25) are arranged in a row and are selectively aligned with one row of the pin holes (15) in the housing (15) when the cylinder (20) is rotated relative to the housing (10).

A stub (27) protrudes from the outer surface of the cylinder (20) and is received in the opening (17) in the housing (10). When the stub (27) abuts against the stop (172) in the opening (17), the rotation of the cylinder (20) will be stopped. Accordingly, the rotation of the cylinder (20) is limited to a desired range by means of the abutment of the stub (27) and the stop (172).

The main adjusting pin assembly (30) is mounted in the main adjusting holes (12, 132, 23) in the housing (10) and the cylinder (20). The main adjusting pin assembly (30) comprises multiple pin blocks (32) and two springs (34). The pin blocks (32) are received in the main adjusting hole (23) in the cylinder and are selectively received in the main adjusting holes (13, 132) in the housing (10). In practice, the pin blocks (32) are designed to have different thickness. The springs (34) are mounted respectively in the main adjusting holes (13, 132) in the housing (10) to push respectively against the pin blocks (32) mounted in the main adjusting holes (13, (132) in the housing (10). In a preferred embodiment, a cap (36) is mounted between each spring (34) and the corresponding pin block (32) to press against the corresponding pin block (32).

The sub-adjusting pin assembly (40) is mounted in the sub-adjusting holes (14,142,24) in the housing (10) and the cylinder (20). The sub-adjusting pin assembly (40) comprises multiple pin blocks (42) and two springs (44). The pin blocks (42) are received in the sub-adjusting hole (24) in the cylinder (20) and are selectively received in the sub-adjusting holes (14,142) in the housing (10). In practice, the pin blocks (42) are designed to have different thickness. The springs (44) are received respectively in the sub-adjusting holes (14,142) in the housing (10) to respectively push against the pin blocks (42) received in the sub-adjusting holes (14,142) in the housing (10). In a preferred embodiment, a cap (46) is mounted between each spring (44) and the corresponding pin block (42) to press against the corresponding pin block (42).

The locking pin assemblies (50) are mounted respectively in the sets of pin holes (15) in the housing (10) and the corresponding pin hole (25) in the cylinder (20). Each locking pin assembly (50) comprises multiple pin blocks (52) and three springs (54). The pin blocks (52) are received in one of the pin holes (25) in the cylinder (20) and are selectively received in the corresponding set of pin holes (15) in the housing (10). In practice, the pin blocks (52) are designed to have different thickness. The springs (54) are received respectively in the corresponding set of the pin holes (15) in the housing (10) to respectively push against the pin blocks (52) received in the pin holes (15) in the housing (10). In a preferred embodiment, a cap (56) is mounted between each spring (54) and the corresponding pin block (52) to press against the corresponding pin block (52).

Figure 3:
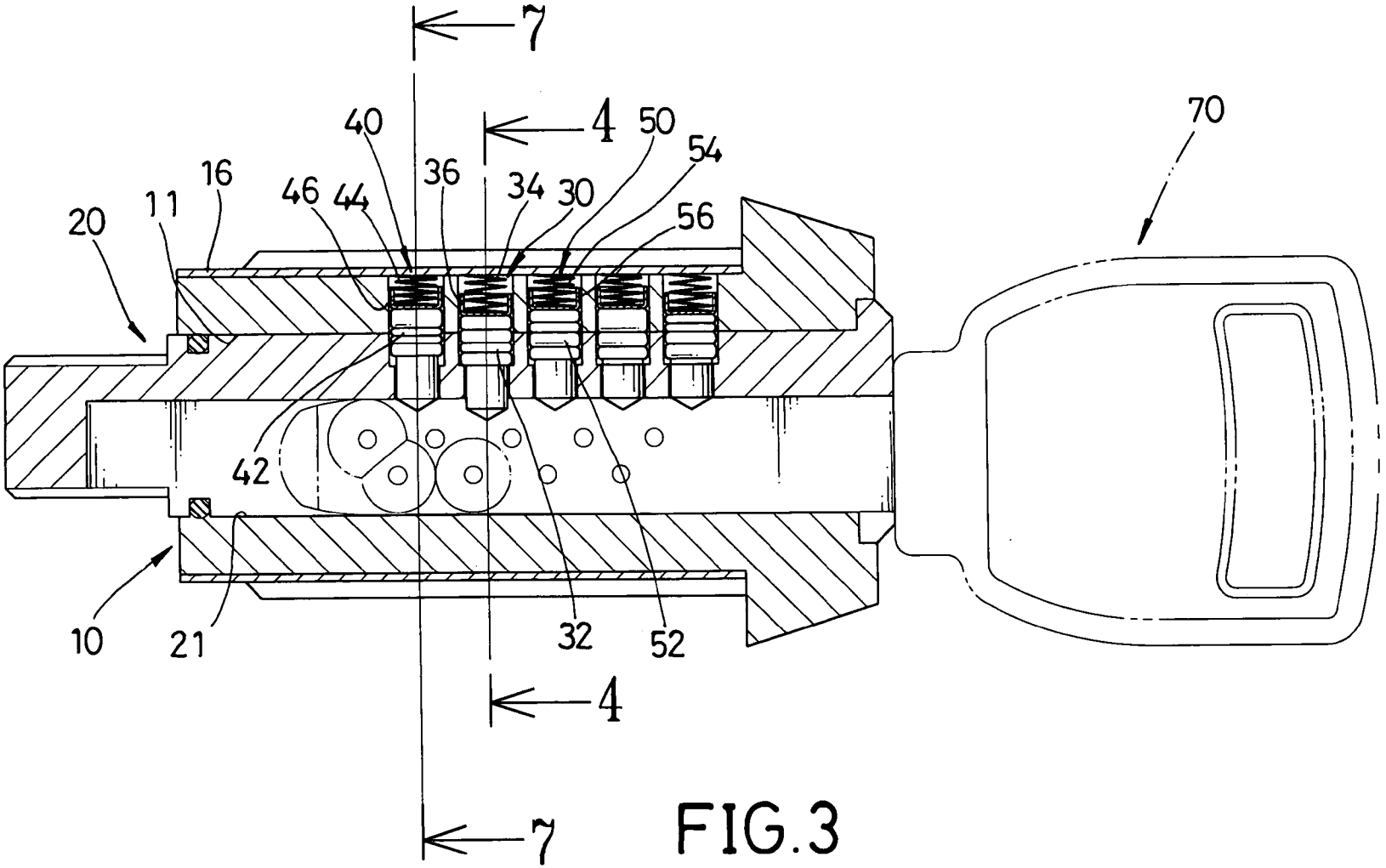
FIG. 3 is a side plan view in partial cross section of the main key and the lock assembly in FIG. 1 along line 3—3 in FIG. 4.
Figure 4:
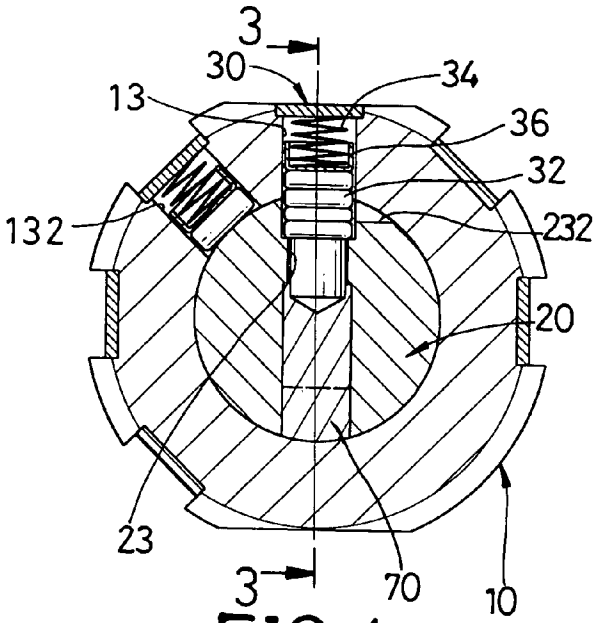
FIG. 4 is a side plan view in partial cross section of the lock assembly along line 4—4 in FIG. 3 showing the main adjusting pin assembly at an open position.
Figure 6:
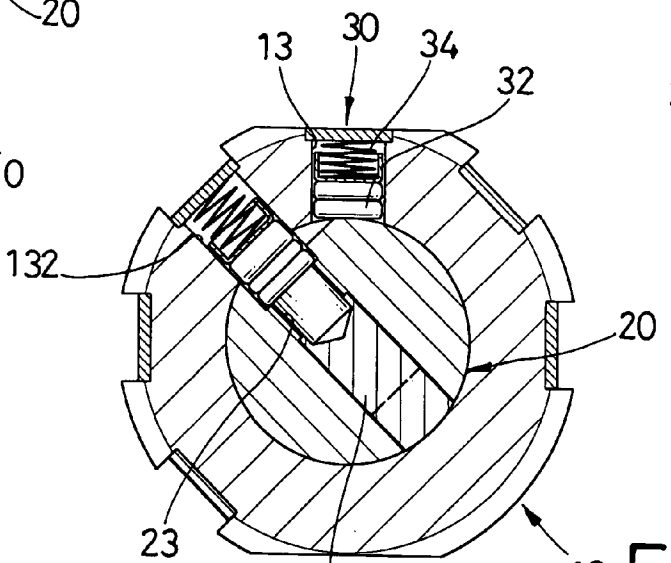
FIG. 6 is a side plan view in partial cross section of the lock assembly in FIG. 4 showing that main adjusting pin assembly at the changing position.
Figure 5:
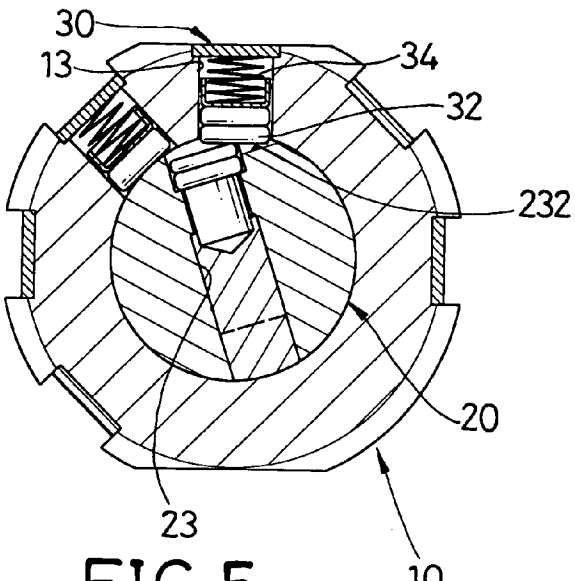
FIG. 5 is an operational side plan view in partial cross section of the lock assembly in FIG. 4 showing that the cylinder is rotated along the second rotating direction from the open position to a changing position.
Figure 7:
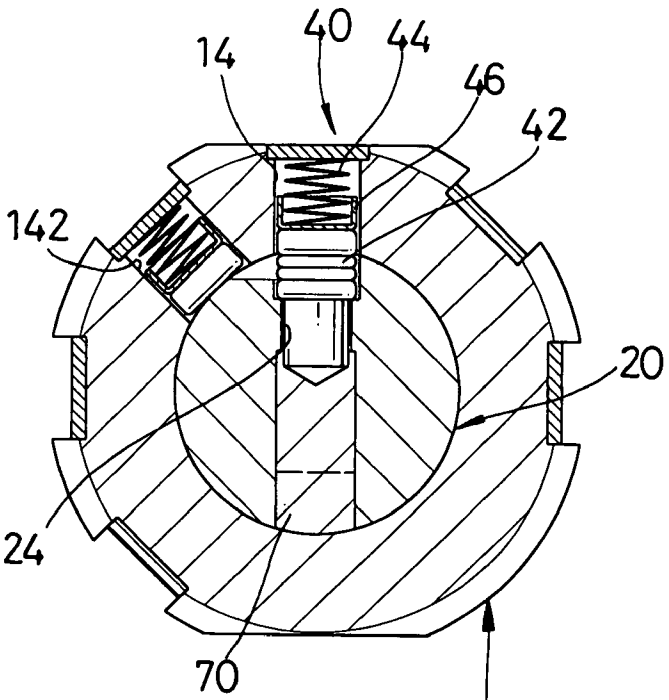
FIG. 7 is a side plan view in partial cross section of the lock assembly along line 7—7 in FIG. 3 showing that one of the pin blocks of the sub-adjusting pin assembly matches with the rotating interface.
Figure 8:
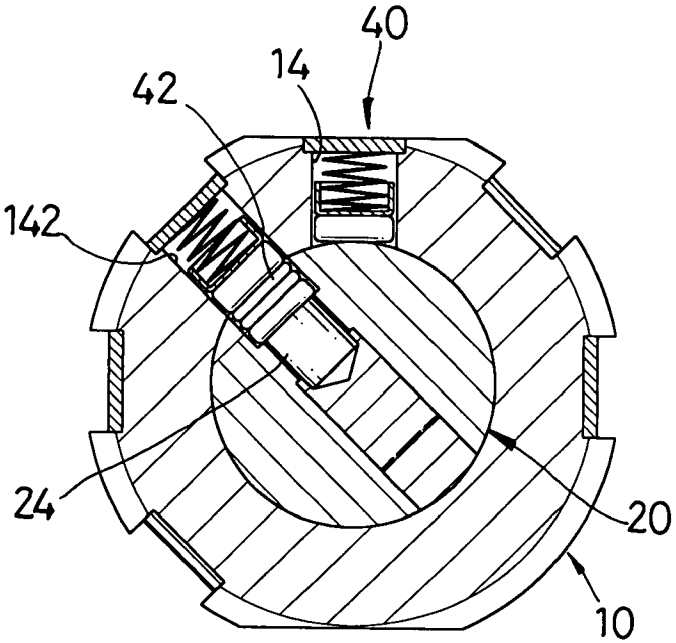
FIG. 8 is a side plan view in partial cross section of the lock assembly in FIG. 7 showing the sub-adjusting pin assembly at the changing position.
Figure 9:
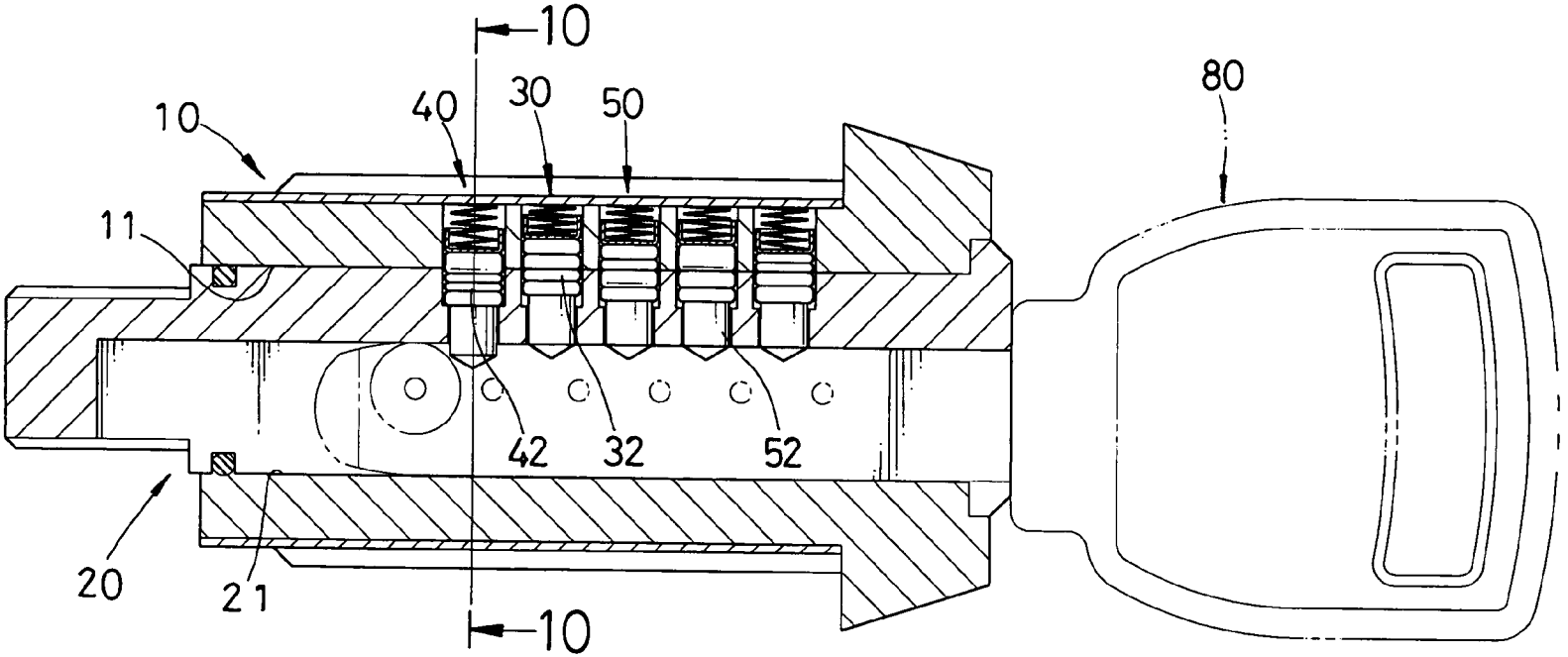
FIG. 9 is a side plan view in partial cross section of the lock assembly in FIG. 1 with a sub key inserted into the key hole along line 9—9 in FIG. 10.
Figure 11:
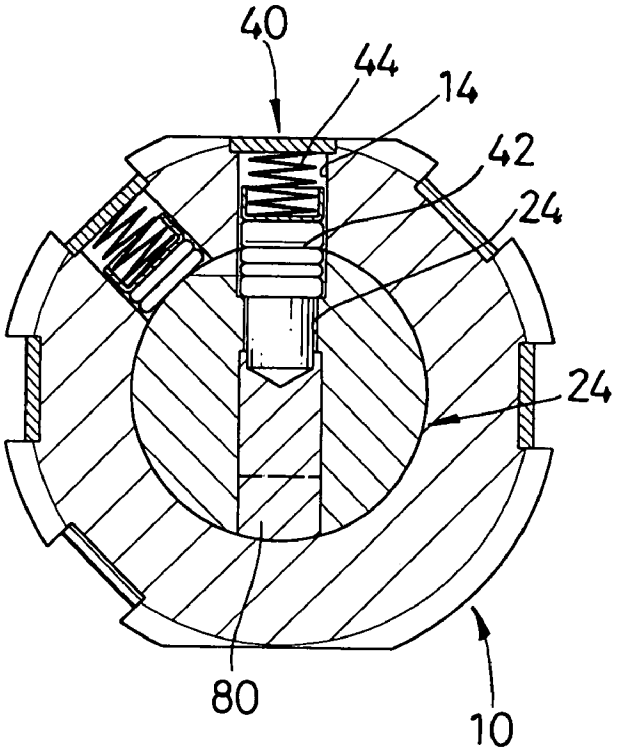
FIG. 11 is a side plan view in partial cross section of the lock assembly in FIG. 10 showing sub-adjusting pin assembly at the open position.
Figure 10:
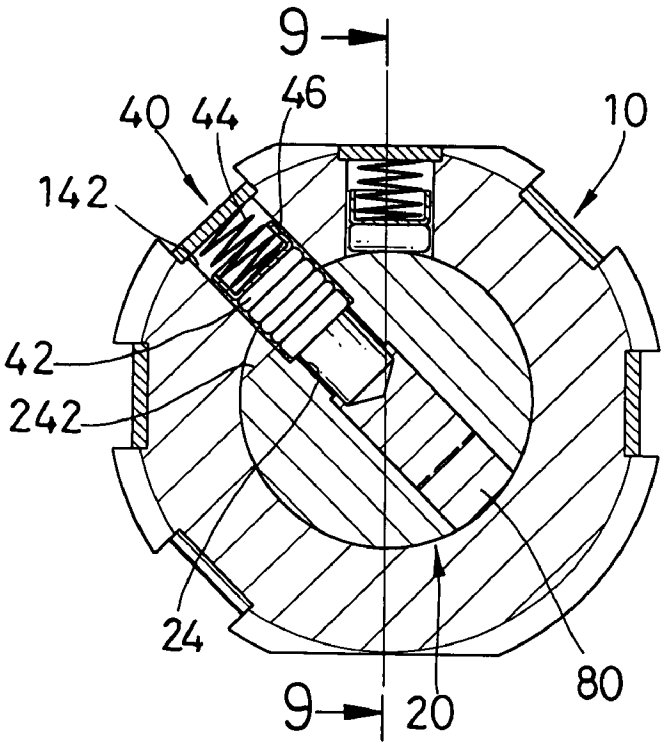
FIG. 10 is a side plan view in partial cross section of the lock assembly along line 10—10 in FIG. 9 showing the sub-adjusting pin assembly at the changing position.

In an original position, the cylinder (20) is positioned at the open position of the lock assembly. With reference to FIGS. 3, 4 and 7, when a main key (70) is inserted into the key hole (21) in the cylinder (20), one of the pin blocks (42) of the sub-adjusting pin assembly (40) and one of the pin blocks (52) of each locking pin assembly (50) both match with the rotation interface to allow the cylinder (20) to rotate, but one of pin blocks (32) of the main adjusting pin assembly (30) interferes with the rotation interface to block the rotation of the cylinder (20). When the user rotates the cylinder (20) along the second rotating direction, with further reference to FIGS. 5, 6 and 8, the pin block (32) blocking the rotation interface will enter into the main-adjusting cavity (232) along the first rotating direction opposite to the second rotating direction. Therefore, the cylinder (20) is able to be rotated along the second rotating direction even though one of the pin blocks (32) of the main adjusting pin assembly (30) blocks the rotation interface. However, the cylinder (20) cannot be rotated along the first rotating direction due to the interference provided by the pin block (32). The pin block (32) blocking the rotation interface will be pushed to enter the main adjusting hole (13) in the housing (10) corresponding to the open position.

When the cylinder (20) is rotated to the changing position, the main key (70) can be taken out of the key hole (21). Then, the pin blocks (32,42,52) in the holes (132,142,15) in the housing (10) corresponding to the changing position will be pushed into the corresponding holes (23,24,25) in the cylinder (20) by the force provided by the springs (34,44, 54).

After that, with reference to FIGS. 2 and 9 to 11, a first sub key (80) can be inserted into the key hole (21) at the changing position. The first sub key (80) has a feature to make one of the pin blocks (32) of the main adjusting pin assembly (30) and one of the pin blocks (52) of each locking pin assembly (50) match with the rotation interface, but also makes one of pin blocks (42) of the sub-adjusting pin assembly (40) interfere with the rotation interface.

Accordingly, when the cylinder (20) is rotated along the first rotating direction, the pin block (42) blocking the rotation interface will enter the sub-adjusting cavity (242) along the second rotating direction. Therefore, the cylinder (20) is able to be rotated along the first rotating direction even though one of the pin blocks (42) of the sub-adjusting pin assembly (40) blocks the rotation interface. The pin block (42) blocking the rotation interface will be pushed to enter the sub-adjusting hole (142) in the housing (40) corresponding to the changing position.

Furthermore, the cylinder (20) can be rotated to the lock position with the first sub key (80). When the key (80) is detached from the key hole (21), the pin blocks (52) of the locking pin assemblies (50) will block the rotation interface to keep the cylinder (20) from rotation so as to lock the lock assembly. In addition, with the feature of the key (80) and different thickness of the pin block (32,42,52), the lock assembly can only be unlocked with a specific key.

Because only two main adjusting holes (13,132) and two sub-adjusting holes (14,142) are defined in the housing (10) but three rows of pin holes (15) are defined in the housing (10), the cylinder (20) can be freely rotated between the open position and the lock position with the first sub key (80) even though there is a pin block (42) of the sub-adjusting pin assembly (40) blocks the rotation interface at the open position.

In addition, because a pin block (42) of the sub-adjusting pin assembly (40) blocks the rotation interface at the open position, the first sub key (80) cannot rotate the cylinder (20) along the second rotating direction. This means the first sub key (80) cannot rotate the cylinder (20) to the changing position.

To adjust the lock assembly, the first sub key (80) is detached from the key hole (21) and the main key (70) is inserted into the key hole. With the feature on the main key (70), the cylinder (20) can be rotated to the changing position as aforementioned. After the main key (70) is detached from the key hole (21), a second sub key (not shown) with a feature different to that of the first sub key (80) can be inserted into the key hole (21). With the second sub key, one of the pin blocks (52) of each locking pin assembly (50) match with the rotation interface. One of the pin blocks (32) of the main adjusting pin assembly (30) matches with the rotation interface, and one of pin blocks (42) of the sub-adjusting pin assembly (40) interferes with the rotation interface. Wherein, the pin blocks (32,42,52) of the main adjusting assembly (30), the sub-adjusting assembly (40) and locking pin assemblies (50) matching with or interfering with the rotation interface can be same as or different from the pin blocks (32,42,52) when the first sub key (70) is inserted into the key hole. This means that the lock assembly has different features when different sub keys are inserted into the key hole (21). Accordingly, after the cylinder (20) is rotated to the open position with the second sub key, the cylinder (20) can only be rotated between the open position and the lock position by the second sub key.

With such a lock assembly, the lock assembly can be conveniently and easily adjusted to fit with different keys according to needs of the user. When the specific key has been illegally copied or lost, the lock assembly can be changed to fit with different keys. Accordingly, not only the safety of using the lock assembly is improved, but also money and time for replacing a new lock assembly are saved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly comprising:

a housing having an outer surface;

a proximal end;

a central hole with an inner surface defined through the housing;

multiple sets of pin holes defined in the housing and communicating with the central hole, and each set of pin holes having three pin holes arranged in a curve along the outer surface of the housing to form three rows of pin holes in the outer surface of the housing, wherein the three holes in the sets of pin holes in the housing are referred to respectively as a changing position, an open position and a lock position of the lock assembly;

two main adjusting holes radially defined in the housing, communicating with the central hole and referred to respectively as the changing position and the open position; and two sub-adjusting holes radially defined in the housing, communicating with the central hole and referred to respectively as the changing position and the open position;

a cylinder rotatably mounted in the central hole of the housing along a first rotating direction and a second rotating direction opposite to the first rotating direction and having an outer surface abutting the inner surface of the central hole in the housing to define a rotation interface between the housing and the cylinder;

a proximal end;

a key hole defined in the proximal end;

a main adjusting hole defined in the outer surface of the cylinder, communicating with the key hole and selectively aligning with one of the main adjusting holes in the housing when the cylinder is rotated relative to the housing;

a main adjusting cavity defined in the outer surface of the cylinder, communicating with the main adjusting hole in the cylinder and extending along the first rotating direction;

a sub-adjusting hole defined in the outer surface of the cylinder, communicating with the key hole and selectively aligning with one of the sub-adjusting holes in the housing when the cylinder is rotated relative to the housing;

a sub-adjusting cavity defined in the outer surface of the cylinder, communicating with the sub-adjusting hole in the cylinder and extending along the second rotating direction; and multiple pin holes defined in the outer surface of the cylinder, communicating with the key hole, arranged in a row and selectively aligned with one row of the pin holes in the housing when the cylinder is rotated relative to the housing;

a main adjusting pin assembly mounted in the main adjusting holes in the housing and the cylinder to block the rotation interface at the main adjusting holes in the housing and the cylinder when a main key is inserted into the key hole in cylinder at the open position of the lock assembly;

a sub-adjusting pin assembly mounted in the sub-adjusting holes in the housing and the cylinder to block the rotation interface at the sub-adjusting holes in the housing and the cylinder when a sub key is inserted into the key hole in the cylinder at the changing position of the lock assembly; and multiple locking pin assemblies mounted respectively in the set of pin holes in the housing and a corresponding pin hole in the cylinder.

2. The lock assembly as claimed in claim 1, wherein the main adjusting pin assembly comprises multiple pin blocks mounted in the main adjusting hole in the cylinder and selectively mounted in the main adjusting holes in the housing; and two springs mounted respectively in the main adjusting holes in the housing to push respectively against the pin blocks mounted in the main adjusting holes in the housing.

3. The lock assembly as claimed in claim 2, wherein the pin blocks have different thicknesses.

4. The lock assembly as claimed in claim 2, wherein the main adjusting pin assembly further has a cap mounted respectively between each respective spring and a corresponding pin block to press against the corresponding pin block.

5. The lock assembly as claimed in claim 1, wherein the sub-adjusting pin assembly comprises multiple pin blocks mounted in the sub-adjusting hole in the cylinder and selectively mounted in the sub-adjusting holes in the housing; and two springs mounted respectively in the sub-adjusting holes in the housing to push respectively against the pin blocks mounted in the sub-adjusting holes in the housing.

6. The lock assembly as claimed in claim 5, wherein the pin blocks have different thicknesses.

7. The lock assembly as claimed in claim 5, wherein the sub-adjusting pin assembly further has a cap mounted respectively between each respective spring and a corresponding pin block to press against the corresponding pin block.

8. The lock assembly as claimed in claim 1, wherein each locking pin assembly comprises multiple pin blocks mounted in one of the pin holes in the cylinder and selectively mounted in a corresponding set of pin holes in the housing; and three springs mounted respectively in the corresponding set of the pin holes in the housing to push respectively against the pin blocks mounted in the pin holes in the housing.

9. The lock assembly as claimed in claim 8, wherein the pin blocks have different thicknesses.

10. The lock assembly as claimed in claim 8, wherein the lock pin assembly further has a cap mounted respectively between each respective spring and a corresponding pin block to press against the corresponding pin block.

11. The lock assembly as claimed in claim 1, wherein the housing further comprises multiple longitudinal recesses longitudinally defined in the outer surface of the housing and each having a bottom;

the main adjusting holes, the sub-adjusting holes and the pin holes in the housing are defined in the bottoms of the longitudinal recesses; and multiple lids are mounted respectively in the longitudinal recesses to close the main adjusting holes, the sub-adjusting holes and the pin holes in the bottoms of the recesses.

12. The lock assembly as claimed in claim 1, wherein the housing further has an opening with an inner surface defined in the proximal end and a curved stop formed on the inner surface of the opening; and the cylinder further has a stub protruding from the outer surface of the cylinder, mounted in the opening in the housing and selectively abutting the stop in the opening.

* * * * *